US009021958B1

(12) United States Patent
Bradbury

(10) Patent No.: US 9,021,958 B1
(45) Date of Patent: May 5, 2015

(54) BROADHEAD-BULLET WITH SABOT

(71) Applicant: Michael Sean Bradbury, Eagle, CO (US)

(72) Inventor: Michael Sean Bradbury, Eagle, CO (US)

(73) Assignee: Michael S. Bradbury, Eagle, CO (US)

( * ) Notice: Subject to any disclaimer, the term of this patent is extended or adjusted under 35 U.S.C. 154(b) by 0 days.

(21) Appl. No.: 14/570,043

(22) Filed: Dec. 15, 2014

Related U.S. Application Data

(63) Continuation-in-part of application No. 14/145,933, filed on Jan. 1, 2014.

(51) Int. Cl.
*F42B 30/02* (2006.01)
*F42B 12/02* (2006.01)
*F42B 6/08* (2006.01)

(52) U.S. Cl.
CPC .. *F42B 12/02* (2013.01); *F42B 6/08* (2013.01)

(58) Field of Classification Search
CPC ..... F42B 12/34; F42B 10/14; F42B 14/06; F42B 30/00; F42B 8/00; F42B 12/68; F42B 5/02; F42B 14/00; F42B 7/08; F42B 10/00
USPC ..... 102/400, 439, 501, 502, 504, 512, 517, 102/520–522, 532, 507, 510
See application file for complete search history.

(56) References Cited

U.S. PATENT DOCUMENTS

| | | | | |
|---|---|---|---|---|
| 948,148 | A | | 2/1910 | Schenk |
| 1,099,784 | A | | 6/1914 | Bizas |
| 1,136,480 | A | | 4/1915 | O'Rawe |
| 1,139,916 | A | | 5/1915 | Stoehr et al. |
| 1,144,818 | A | | 6/1915 | Damer |
| 1,204,950 | A | | 11/1916 | Damer |
| 1,205,715 | A | | 11/1916 | Crane |
| 1,225,497 | A | | 5/1917 | Rodzikevitch |
| 1,152,668 | A | | 9/1917 | Sullivan |
| 1,318,858 | A | | 12/1919 | Erick |
| 1,330,291 | A | | 2/1920 | Witkowski et al. |
| 1,464,032 | A | | 8/1923 | Daynik |
| 2,014,367 | A | | 9/1935 | Breegle |
| 2,661,694 | A | | 5/1950 | Allen et al. |
| 3,687,398 | A | * | 8/1972 | Beuschel ..... 244/3.24 |
| 3,893,866 | A | | 7/1975 | Hollingsworth |
| 3,897,730 | A | * | 8/1975 | Riparbelli ..... 102/374 |
| 4,334,657 | A | | 6/1982 | Mattson |
| 4,408,538 | A | | 10/1983 | Deffayet et al. |
| 4,644,866 | A | | 2/1987 | Sullivan |
| 4,729,320 | A | | 3/1988 | Whitten, III |
| 4,976,443 | A | | 12/1990 | DeLucia |
| 5,020,438 | A | | 6/1991 | Brown |
| 5,066,021 | A | | 11/1991 | DeLucia |
| 5,078,407 | A | | 1/1992 | Carlston |
| 5,116,224 | A | | 5/1992 | Kelsey, Jr. |
| 5,133,261 | A | | 7/1992 | Kelsey, Jr. |
| 6,174,252 | B1 | | 1/2001 | Mizek |
| 6,217,467 | B1 | | 4/2001 | Maleski |
| 6,234,082 | B1 | | 5/2001 | Cros et al. |
| 6,240,849 | B1 | | 6/2001 | Holler |
| 6,439,127 | B1 | | 8/2002 | Cherry |
| 6,571,715 | B1 | | 6/2003 | Bennett et al. |
| 6,588,700 | B2 | | 7/2003 | Moore et al. |
| 7,178,462 | B2 | | 2/2007 | Beasley |
| 8,646,388 | B1 | | 2/2014 | Bradbury |
| 2005/0217528 | A1 | | 10/2005 | Beasley |

* cited by examiner

*Primary Examiner* — Jonathan C Weber

(57) ABSTRACT

The Broadhead-Bullet and Sabot is a new type of sub-sonic hunting projectile combining capabilities of an expandable broad head arrowhead with that of a firearm-fired projectile. The Broadhead-Bullet and Sabot is for use in shorter ranges akin to shotgun slug ranges but is able to utilize the cost effectiveness, utility, and ease of use of existing firearms.

16 Claims, 5 Drawing Sheets

BROADHEAD-BULLET WITH SABOT

CROSS-REFERENCE TO RELATED APPLICATION

This application is a CIP of Ser. No. 14/145,933 Filed Jan. 1, 2014 by the present inventor which is incorporated by reference.

FEDERALLY SPONSORED RESEARCH

Not Applicable

SEQUENCE LISTING OR PROGRAM

Not Applicable

BACKGROUND OF INVENTION

1. Field of Invention

This invention relates to firearm projectiles, more specifically a firearm projectile that combines the functionality of a retractable broad head arrowhead with that of a shotgun shell intended for use with smoothbore shotguns.

2. Prior Art

The use of projectiles for big game hunting has been a unique method of hunting for mankind since the beginning written history. Mankind's ingenuity has perfected the firearm projectile into a highly effective hunting tool, specifically discussed here are the methods of hunting utilizing a bow and arrow and also that of the firearm and bullet. Both methods deliver a greatly enhanced method of harvesting meat via hunting and both methods offer their own advantages and disadvantages when compare to the other method of hunting discussed here. Unfortunately neither method it compatible with each other, both methods needs to be immersed within its own discipline with both the strategy and with equipment used to hunt. There have been attempts in the past to incorporate the advantages of both methods of hunting, bow and arrow and gun and bullet, but all have failed to bring a significantly superior product to the consumer market as their designs lack functionality, are too costly, do not perform well, or just plain do not work. The following are descriptions of prior art and discussions as to why these products have not been successful.

U.S. Pat. No. 1,318,858 was issued to John Frick for an expansible projectile for use in firearms and the like. Frick's invention has "outwardly projecting arms or cutting blades which are automatically positioned either due to the force of explosion or by the impact of the projectile against an object." Unfortunately Frick's invention utilizes a complex arrangement to deploy his blades including a plunger. This construction and operation of his expansible projectile make it expensive and too difficult to implement in a practical manner. The plunger style orientation for deploying the blades is also not reliable, as any variation of impact may not activate the plunger correctly. Frick's projectile also does not utilize a sabot to protect his blade while traveling the length of the firearm barrel thus allowing for destabilizing forces to disrupt the intended trajectory. The present invention is intended for use in a firearm with a smoothbore barrel such as a 12-gauge shotgun. The Broadhead Bullet relies upon a sabot or several blade mounted sabots to accurately guide it though the length of the firearm barrel.

U.S. Pat. No. 2,661,694 was issued to James Allen and William Cantrell for the Spreader Panel Bullet that "spread laterally upon impact with an object". As with Frick's invention the Spreader Panel Bullet does not incorporate a sabot to encase the projectile thus necessitating the blades and its supporting mechanisms to be encase within the projectile.

This configuration is too complicated and expensive for the projectile to be except in specialty situations. The blades also are not connected to the projectile and only deploy in a forward swept position thus severely hindering its damaging potential, as this design would quickly slow the projectile as it enters the target medium. The blades would be subject to ejection from the projectile causing unpredictable performance. The supporting mechanisms for deploying the blades are complicated and therefore would be expensive and difficult to implement. The present invention utilizes a much simpler and more effective design and would thus be less expensive and yield better performance.

U.S. Pat. No. 5,078,407 was issued to Marvin Carlston for his Expandable Blade, Composite Plastic, and Broadhead Hunting Arrow Tip. Carlston here describes the use of "rotatable blades which are trunnion mounted securely in the body of the tip, and which are designed to be partially exposed while in flight". Carlston describes the function of the blades as being able to "rotate into an expanded position upon impact" and "the blades are mounted in a forward position with the tips of the blades protruding outside of the tip body". Carlston's design is one of simplicity and functionality and has been proven successful in the marketplace. Carlston's invention however is designed for bow hunting and is not for use with firearms, therefore it does not have any relevance to the present invention.

U.S. Pat. No. 6,240,849 was awarded to Christopher Holler for the Projectile with Expanding Members. Holler's invention has "open-biased arm members" that are "compressed into a restrained position" before firing the bullet. When the bullet is fired "the arms extend to the unrestrained position" which then catch the target material and slow the projectile down. Holler's invention is for a projectile suited for use in a rifled barrel and not a smooth bore shotgun as it relies upon centrifugal force for stabilization. Also his arms extend when the projectile is fired and not upon impact thus creating a massive amount of drag upon the projectile thus making it grossly inefficient as a projectile. Holler's projectile unfortunately may not be a feasible working projectile as it has many lacking characteristics that prevent it from becoming a workable firearm projectile.

U.S. Pat. No. 7,178,462 was awarded to Beasley for the Projectile with Members that Deploy Upon Impact. Beasley's projectile relies upon a "nose piece that shears off upon impact with the target, causing the nose piece to be pushed inside the projectile". The "nose piece pushes on members that deploy outwardly and lock into place, thereby greatly increasing the damage done to the target". Beasley's invention, much like Holler's, is a projectile intended for use within a rifled barrel and not a smoothbore barrel as it relies upon centrifugal force for stabilization of the projectile. Beasley's members or blades reside inside of the projectile and require an intricate mechanical arrangement for the deployment of the blades. Also the members or blades are unfortunately restricted in size due to the stowing of the blades within the bullet thus the members are also severely restricted in the amount of damage the can inflict upon the target. In all Beasley's projectile is complicated in use and construction and offers minimal advantage for the members to inflict damage therefore the concept has minimal value for its intended purpose.

OBJECTS AND ADVANTAGES

The advantages of the Broadhead Bullet are as follows:

To produce a firearm fired projectile that is statically stabilized in flight.

To produce a projectile that does not rely upon rifled barrels and centrifugal force for the projectiles stabilization.

To produce a sub-sonic firearm projectile that produces a significantly lower noise signature than traditional super-sonic firearm.

To produce a low kinetic energy firearm projectile for use in a smoothbore firearm that can be used for hunting large game such as deer and elk.

To produce a firearm fired projectile with a finned stabilizer that releases from the projectile upon impact.

To produce an expandable broad head projectile that creates a wounding effect that is similar to conventional archery broad heads on the market.

To produce a firearm projectile for use in limited range projectile hunting areas as defined by hunting laws.

To produce a low kinetic energy subsonic hunting round that can be used in a smoothbore barreled firearm that would function within the firearm's action, as would ammunition for the same currently on the consumer market without modification to the function of the firearm.

To produce a firearm projectile for use in 12 gauge shotguns with less recoil than Foster slugs and Buckshot.

To produce a projectile with a 100-yard center of hold for the animals kill zone. No need for specialized optics for effective hunting within 100 yards.

REFERENCE NUMERALS

1. Projectile shaft
3. Penetrating tip
5. Pivoting blade support
7. Pivoting blade
9. Fin unit
11. Pivoting blade spine
13. Pivoting blade stop
15. Broadhead Bullet shot shell
17. Pivoting blade edge
19. Broadhead Bullet assembly
21. Pivoting blade tang
23. Pivoting blade sheath
25. Fin unit support
27. Fore end sabot
29. Aft end sabot
31. Powder charge
33. Hull
35. Firearm barrel
37. Target material

ILLUSTRATION DESCRIPTION

Figure 12:
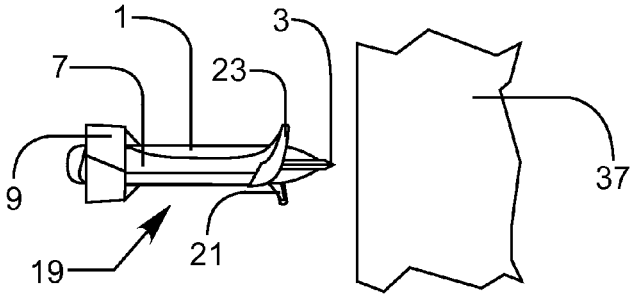

FIG. 12 details the Broadhead-Bullet in flight before impacting the Target material.

Figure 13:
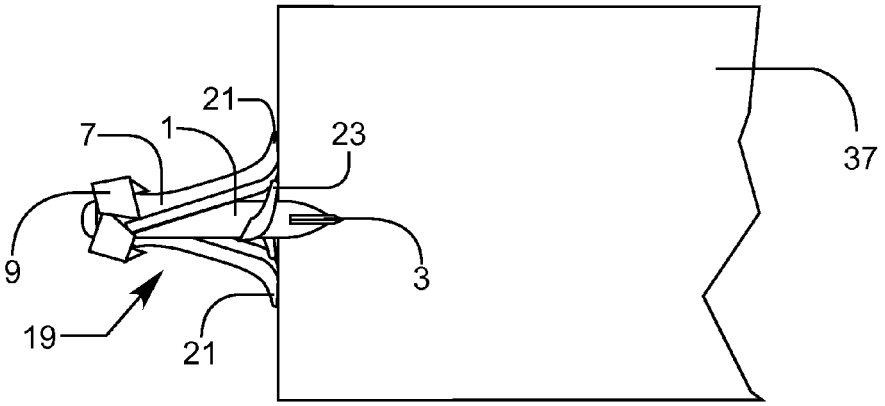

FIG. 13 details the Broadhead-Bullet contacting the Target material, the Pivoting blades deploying.

Figure 14:
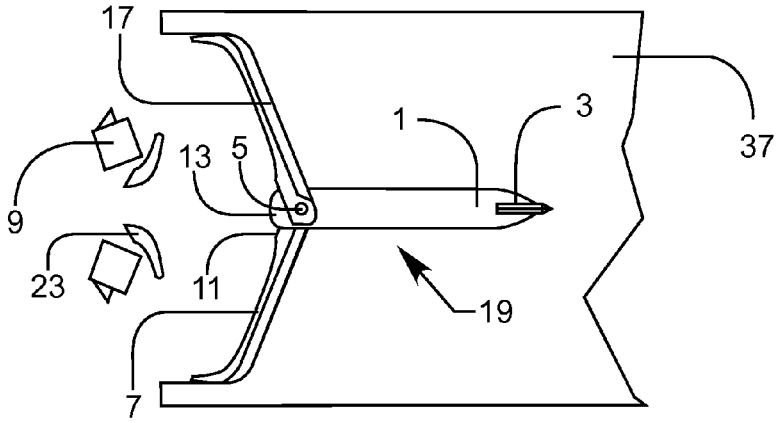

FIG. 14 details the Broadhead-Bullet inside of the Target material, Pivoting Blades in fully deployed position.

DESCRIPTION

Broadhead-Bullet and Sabot FIGS. 1-14

Pivoting blades 7 are attached to opposite sides of Projectile shaft 1 via Pivoting blade rod support 5. Pivoting blades 7 when in the stowed position are rotated forward on Pivoting blade support 5 such that Pivoting blade edge 17 is flush with the edge of Projectile shaft 1. Pivoting blade tang 21 is at located fore end of Pivoting blade 7, opposite from the Pivoting blade support 5 located at the aft end of The Pivoting Blade 7. Pivoting blade tang 21 has a shape that extends outward from the spine of the Pivoting blade 7. The fore end portion of Pivoting blade tang 21 is blunt in comparison to Pivoting blade edge 17. Pivoting blade sheath 23 is attached to and encases the fore portion of the Pivoting blade tang 21. Pivoting blade sheath 23 is constructed from an impact resistant material such as plastic.

The Projectile shaft 1 is weight biased towards the fore end of the projectile with Penetrating tip 3 located at the foremost portion of the Projectile shaft 1. Both the Projectile shaft 1 and the Penetrating tip 3 here are constructed from an impact resistant material such as steel or high impact plastic. The aft end of the Projectile shaft 1 is lighter than the fore end and is constructed from a durable and deformation resistant material. When the Projectile shaft 1 is coupled with the Aft end sabot 29 and Fore end sabot 27 the Broadhead-Bullet assembly 19 can withstand intact the peak pressure created during firing without deformation to the Assembly 19.

The Pivoting blade support 5 here is made from a high tensile strength material such as steel and retains the Pivoting blades 7 to the Projectile shaft 1. Each Pivoting blade 7 is capable of pivoting counter rotational to the opposing Pivoting blade 7 on the Pivoting blade support 5. The Projectile shaft 1 has Pivoting blade stops 13 at the aft portion and on opposing sides of the Projectile shaft 1 and behind Pivoting blades 7. Pivoting blade stops 13 here are molded into the Projectile shaft 1 construction. When Pivoting blades 7 are in the fully deployed position the Pivoting blade spine 11 portion of the Pivoting blades 7 contacts the Pivoting blade stop 13. Pivoting blades 7, when in the fully deployed position have Pivoting blade edges 17 that face towards the fore end of the Broadhead-Bullet assembly 19.

The Fin units 9 is located near the rearward portion of and encase the Projectile shaft 1 and stowed Pivoting blades 7. Fin units 9 combine from two separate parts to surround both the Projectile shaft 1 and Pivoting blades 7. The Fin units 9 separate and eject from the Projectile shaft 1 and Pivoting blades 7 when the Pivoting blades 7 deploy.

Figure 1:
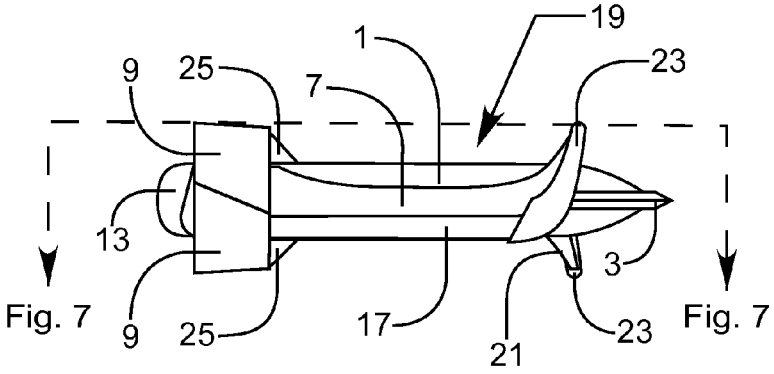
FIG. 1 is a side view of the Broadhead-Bullet.
Figure 2:
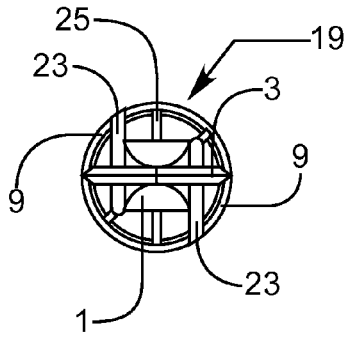
FIG. 2 is a front view of the Broadhead-Bullet from FIG. 1.
Figure 3:
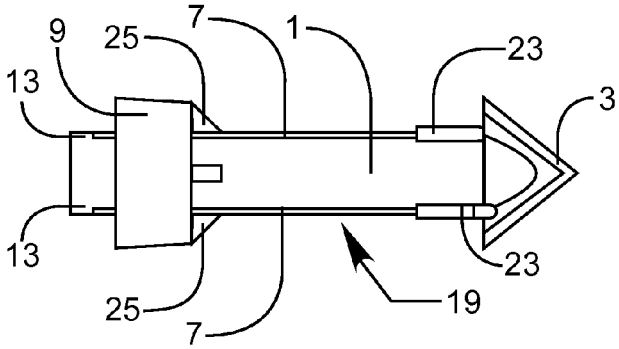
FIG. 3 is a side view of the Broadhead-Bullet from FIG. 1 rotated 90 degrees on its horizontal axis.
Figure 4:
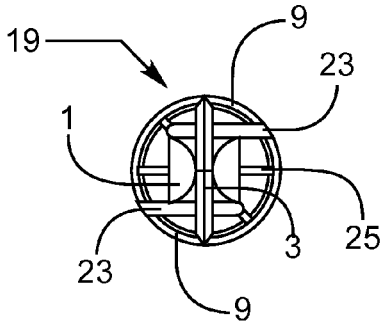
FIG. 4 is a front view of the Broadhead-Bullet from FIG. 3.
Figure 5:
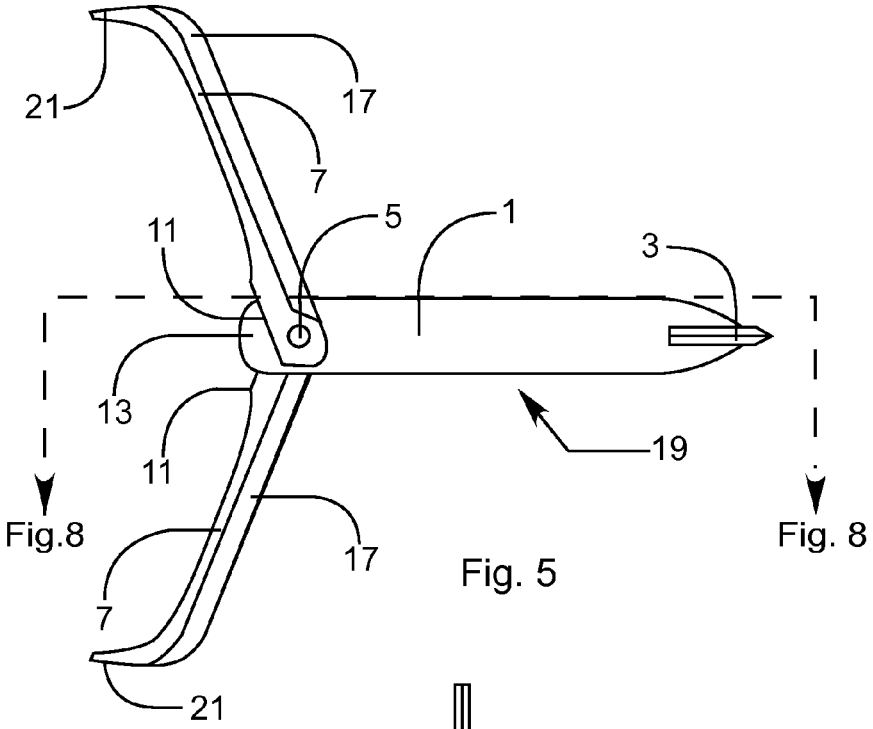
FIG. 5 is a Broadhead-Bullet side view from FIG. 1 with the Pivoting blades deployed and the fin units and the pivoting blade sheaths absent.
Figure 6:
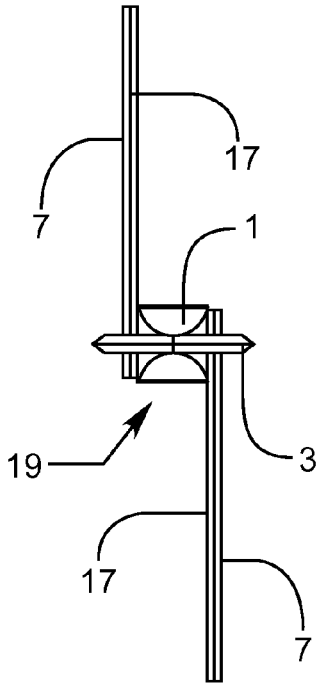
FIG. 6 is a front view from FIG. 5 of the Broadhead-Bullet.
Figure 7:
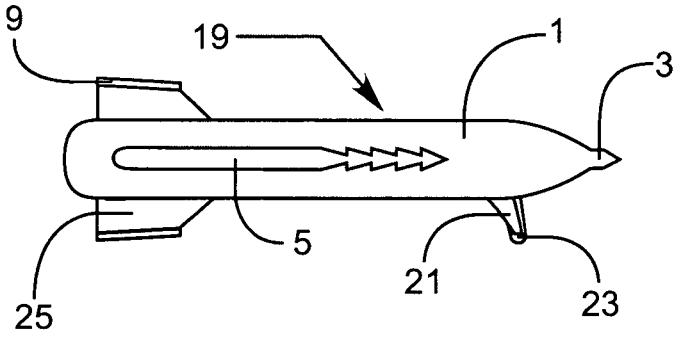
FIG. 7 is a Broadhead-Bullet cross-sectional view from FIG. 1.
Figure 8:
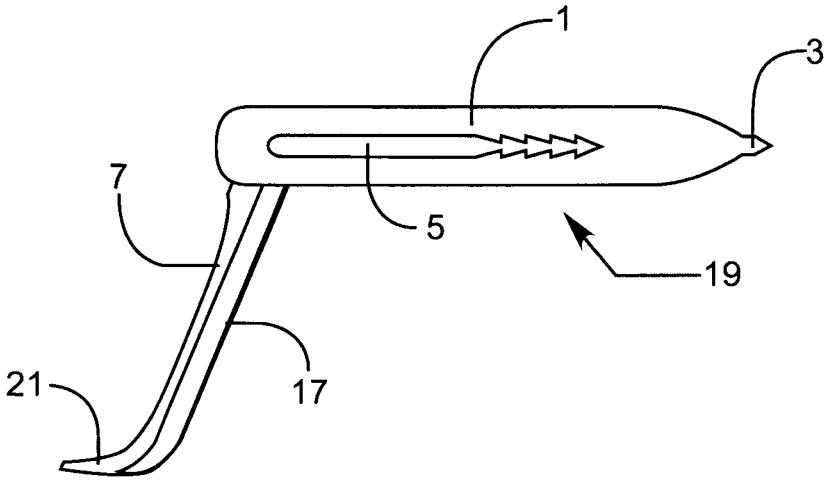
FIG. 8 is a Broadhead-Bullet cross-sectional view from FIG. 5.
Figure 11:
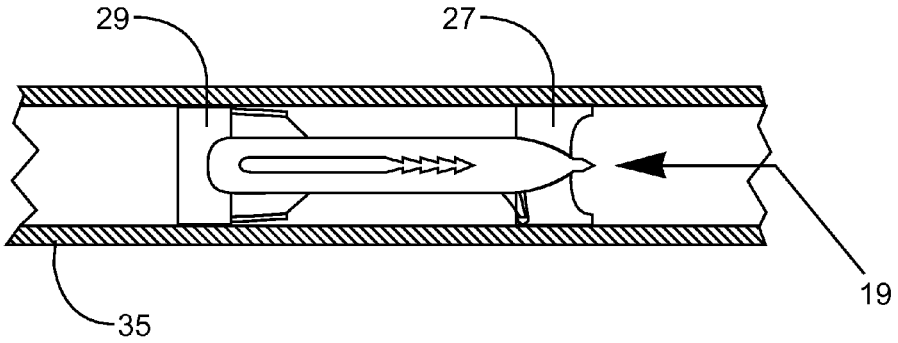
FIG. 11 is a Broadhead-Bullet inside of a gun barrel cross-sectional view.
Figure 10:
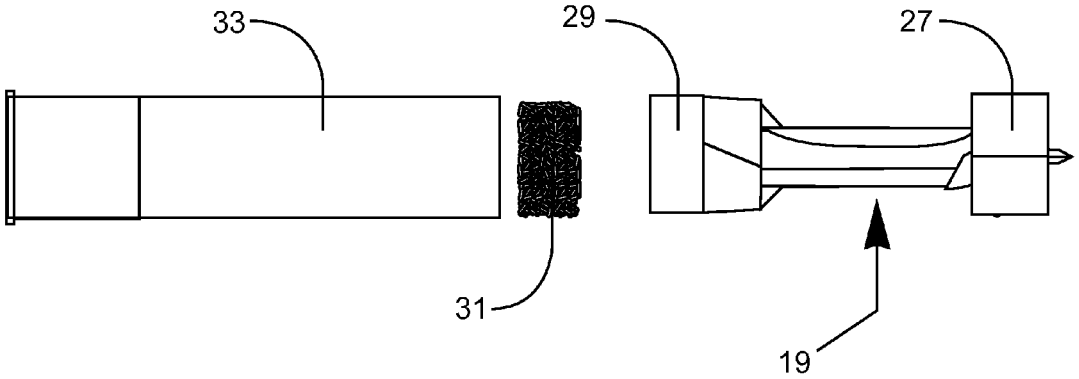
FIG. 10 is a Broadhead-Bullet shell exploded view.
Figure 9:
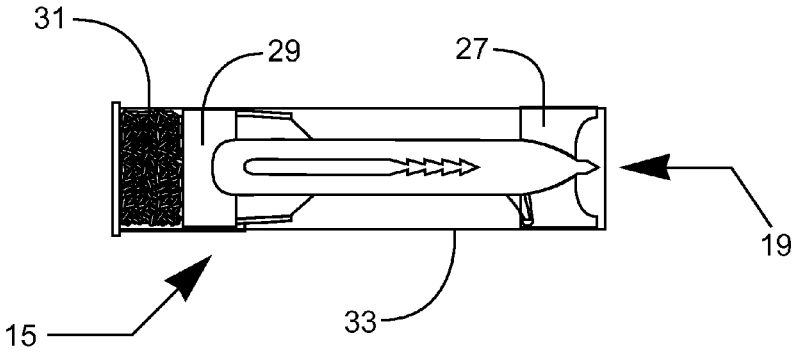
FIG. 9 is a Broadhead-Bullet shell cross-sectional view.

FIG. 9 details the Broadhead-Bullet shot shell 15 containing the Broadhead Bullet assembly 19, Powder charge 31, Aft end sabot 29, and Fore end sabot 27. FIG. 10 is an exploded view of the same components as FIG. 9. FIG. 11 details the Broadhead Bullet 19, Aft end sabot 29, and Fore end sabot 27 in a smooth bore Firearm barrel 35.

Fore end sabot 27 here consists of four parts whose outer circumferences are equal to one another and whose inner circumference is mated shapewise to the outer circumference of the Broadhead Bullet portion that each respective Fore end sabot 27 is supporting. Fore end sabot 27 portions are contained onto the Broadhead Bullet assembly 19 while in the Hull 33 and in the Firearm barrel 35. Fore end sabot 27 is able to separate from the Broadhead Bullet assembly 19 when the Assembly 19 exits the Firearm barrel 35.

Aft end sabot 29 consists of one piece and is in contact with the rear portion of the Broadhead Bullet assembly 19. Aft end sabot 29 is capable of enduring the peak chamber pressure resulting from the firing of the Broadhead Bullet shot shell 15 without distortion, damage, or disintegration to the Aft end Sabot 29. Aft end sabot 29 is contained onto the Broadhead Bullet assembly 19 while in the Hull 33 and Firearm barrel 35.

FIGS. 12-14 detail the Broadhead-Bullet assembly 19 contacting the Target material 37. FIG. 12 details the Broadhead-Bullet assembly 19 in flight before impacting the Target material 37. FIG. 13 details the Broadhead-Bullet 19 contacting the Target material 37; the Pivoting blades 7 beginning their deployment and the Fin unit 9 separating. The Penetrating tip 3 initiates the penetration of the Broadhead Bullet assembly 19 into the Target material 37. FIG. 14 details the Broadhead-Bullet assembly 19 inside of the Target material 37. Here the Pivoting Blades 7 are in the fully deployed position, the Fin unit 9 portions are ejected from the Pivoting blades 7 and Projectile shaft 1. The Broadhead-Bullet SS assembly 19 continues to travel through the Target material 37 with the Pivoting blades 7 cutting a wound channel through the Target material 37 until its kinetic energy is depleted.

Operation of Invention

Broadhead-Bullet with Sabot FIGS. 1-14

The Broadhead Bullet shot shell 15 is capable of operating in a conventional manually operated action shotgun as any conventional shot or slug filled shotshell would without modification to the shotgun. When the Broadhead Bullet 19 is inside the Hull 33, Firearm barrel 35, or in flight the Pivoting blades 7 are in the stowed position and are flush with Projectile shaft 1. The Pivoting blade tang 21 or Pivoting blade sheath 23 are in contact with the Penetrating tip 3 preventing the Pivoting blade 7 from rotating towards the Pivoting blade edge 17 facing direction. The two Fin unit 29 parts are in contact with each other to form a continuous single Fin unit 29. When the Broadhead-Bullet Shot Shell 15 is fired, the Powder charge 31 burns creating expanding gasses that pushes the Aft end sabot 29 against the Broadhead-Bullet assembly 19. Aft end sabot 29, Fore end sabot 27, and Broadhead Bullet assembly 19 exit the Hull 33 and enter into the Firearm barrel 35. The Fore end sabot 27 and Aft end sabot 29 guide the Broadhead Bullet 19 through the Firearm barrel 35 maintaining its travel along the central axis of the Firearm barrel 35. Upon exiting the Firearm barrel 35 the Fore end sabot 27 and Aft end sabot 29 encounter great pressure from the ambient air and eject from the Broadhead Bullet 19.

While in flight the Fin unit 9 creates a downward pressure onto the Pivoting blades 7 and Projectile shaft 1, via air flowing across the Fin unit 9. This pressure maintains the Pivoting blades 7 stowed position during flight until the Broadhead-Bullet 19 either strikes the Target material 37 or reaches a zero velocity state. Fin unit support 25 maintains the desired shape of the Fin unit 9 adding stability to the Broadhead-Bullet 19 during flight.

The Fin unit 9 also creates a center of pressure that is oriented toward the aft end of the Broadhead Bullet 19. This aft end oriented center of pressure in combination with a fore end oriented center of gravity insures a stable projectile in flight and a consistant trajectory.

The Broadhead-Bullet 19 maximum velcity would be a sub-sonic velocity of about 1000 ft/sec or 3 times the velocity compared to an arrow fired from a high-powered compound bow. This velocity would give the Broadhead Bullet 19 an effective range of roughly 100 yards thus allowing for it to be used in areas limited to short ranges due to applicable hunting regulations. The trajectory of the Broadhead-Bullet 19 aggressively deteriorates beyond 100 yards.

A Pivoting blade sheath 23 is attached to and encases the fore portion of the Pivoting blade tang 21. As the Broadhead-Bullet 19 strikes the Target material 37 the Pivoting blade sheaths 23 and the Penetrating tip 3 are the first portions of the Broadhead-Bullet 19 to contact the Target material 37. As the Penetrating tip 3 penetrates into the Target material 37 the Pivoting blade sheaths 23 remain on the exterior of the Target material 37. Pivoting blades tangs 21 slide along the inside portion of Pivoting blades sheaths 23 forcing the Pivoting blades 7 to rotate on Pivoting blade support 5 and outward from their stowed position and into the deploying position. The Pivoting blades 7 ends deployment when Pivoting blade spine 11 contact Pivoting blade stops 13. Here the Pivoting blades 7 are oriented such that Pivoting blade edges 17 are facing forward towards the Penetrating tip 3. As the Broadhead-Bullet 19 enters the Target material 37 the Pivoting blade sheaths 23 and Fin units 9 are ejected from the Broadhead-Bullet 19. The Pivoting blades 7 cut a wound channel through the Target material 37 until the Broadhead-Bullet 19 depletes its kinetic energy.

Projectile shaft 1 will provide the Broadhead-Bullet 19 the majority of the kinetic energy it requires to complete its trajectory, penetrate and pull it through the Target material 37. The Pivoting blade support 5 is connected the Projectile shaft 1 retains the Pivoring blades 7 when the Broadhead-Bullet 19 strikes the Target material 37 thus keeping the Pivoting blades 7 connected to the Broadhead-Bullet 19.

The invention claimed is:

1. A new type of sub-sonic firearm projectile for use in a smoothbore barrel firearm comprising:

a. a projectile shaft whereby said projectile shaft has a center of gravity biased towards the fore end of said projectile shaft;

b. a penetrating tip located at the fore end of said projectile shaft whereby said penetrating tip initiates the penetration of said firearm projectile into target material;

c. a blade support located at the aft end of said projectile shaft, said blade support is attached to said projectile shaft whereby said blade support retains pivoting blades to said projectile shaft;

d. two said pivoting blades attached to said blade support whereby each of said pivoting blades can pivot counter rotational to the opposing said pivoting blade on said blade support;

e. at least one shaft blade stop located at the aft end of said projectile shaft, said pivot blade stop terminates the deployment of said pivoting blade when a spine of said pivot blade contacts said shaft blade stop; and f. a fin unit attached to the aft portion of said projectile whereby said fin unit creates a center of pressure biased towards the aft end of said projectile shaft, said fin unit is released from the projectile when said pivoting blades deploy.

2. The projectile from claim 1 further including a projectile sabot whereby said projectile sabot sheaths the projectile and whereby said projectile sabot absorbs a portion of peak pressure created during propellant burn, said projectile sabot is releasable from the projectile when the projectile exits the firearm barrel.

3. The projectile from claim 2 further including a shotshell containing a powder charge, said projectile sabot, and said sub-sonic firearm projectile.

4. The projectile from claim 1 further including at least one pivoting blade sabot affixed to the fore end portion of each said pivoting blade whereby said pivoting blade sabots resist said pivoting blade from penetrating said target material when said pivoting blade is in the stowed position, and whereby said pivoting blade slides against said pivoting blade sabot initiating deployment of said pivoting blade, and whereby said pivoting blade sabot is releasable from said pivoting blade when said pivoting blade is in the deployed position.

5. The projectile from claim 4 further including a projectile sabot whereby said projectile sabot sheaths the projectile and whereby said projectile sabot absorbs a portion of peak pressure created during propellant burn, said projectile sabot releases from the projectile when the projectile exits the firearm barrel.

6. The projectile from claim 5 further including a shotshell containing a powder charge, said projectile sabot, and said sub-sonic firearm projectile.

7. A new type of sub-sonic firearm projectile for use in a smoothbore barrel firearm comprising:

a. a projectile shaft whereby said projectile shaft has a center of gravity biased towards the fore end of said projectile shaft; and whereby the aft portion of said projectile shaft has a compressive yield strength greater than peak pressure during propellant burning;

b. a penetrating tip located at the fore end of said of said projectile shaft whereby said penetrating tip initiates the penetration of said firearm projectile into target material;

c. a blade support located at the aft end of said projectile shaft, said blade support is attached to said projectile shaft whereby said blade support retains pivoting blades to said projectile shaft;

d. two said pivoting blades attached to said blade support whereby each of said pivoting blades can pivot counter rotational to the opposing said pivoting blade on said blade support;

e. at least one shaft blade stop located at the aft end of said projectile shaft, said pivot blade stop terminates the deployment of said pivoting blade when a spine of said pivot blade contacts said shaft blade stop;

f. a fin unit attached to the aft portion of said projectile whereby said fin unit creates a center of pressure biased towards the aft end of said projectile shaft, said fin unit is released from the projectile when said pivoting blades deploy.

8. The projectile from claim 7 further including a projectile sabot whereby said projectile sabot sheaths the projectile, said projectile sabot releases from the projectile when the projectile exits the firearm barrel.

9. The projectile from claim 8 further including a shotshell containing a powder charge, said projectile sabot, and said sub-sonic firearm projectile.

10. The projectile from claim 7 further including a projectile sabot whereby said projectile sabot sheaths the projectile and whereby said projectile sabot absorbs a portion of peak pressure created during propellant burn, said projectile sabot releases from the projectile when the projectile exits the firearm barrel.

11. The projectile from claim 10 further including a shotshell containing a powder charge, said projectile sabot, and said sub-sonic firearm projectile.

12. The projectile from claim 7 further including at least one pivoting blade sabot affixed to the fore end portion of each said pivoting blade whereby said pivoting blade sabots resist said pivoting blade from penetrating said target material when said pivoting blade is in the stowed position, and whereby said pivoting blade slides against said pivoting blade sabot initiating deployment of said pivoting blade, and whereby said pivoting blade sabot is releasable from said pivoting blade when said pivoting blade is in the deployed position.

13. The projectile from claim 12 further including a projectile sabot whereby said projectile sabot sheaths the projectile and said projectile sabot releases from the projectile when the projectile exits the firearm barrel.

14. The projectile from claim 13 further including a shotshell containing a powder charge, said sabot, and said sub-sonic firearm projectile.

15. The projectile from claim 12 further including a projectile sabot whereby said projectile sabot sheaths the projectile and whereby said projectile sabot absorbs a portion of peak pressure created during propellant burn, said projectile sabot releases from the projectile when the projectile exits the firearm barrel.

16. The projectile from claim 15 further including a shotshell containing a powder charge, said projectile sabot, and said sub-sonic firearm projectile.

* * * * *